US008537301B2

(12) United States Patent
Park et al.

(10) Patent No.: US 8,537,301 B2
(45) **Date of Patent: *Sep. 17, 2013**

(54) METHOD OF FABRICATING BOTTOM CHASSIS, BOTTOM CHASSIS FABRICATED BY THE METHOD OF FABRICATING THE SAME, METHOD OF FABRICATING LIQUID CRYSTAL DISPLAY, AND LIQUID CRYSTAL DISPLAY FABRICATED BY THE METHOD OF FABRICATING THE SAME

(75) Inventors: Sang-Joon Park, Hwaseong-si (KR); Tae-Seok Kim, Suwon-si (KR); Tae-Seok Jang, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 382 days.

This patent is subject to a terminal disclaimer.

(21) Appl. No.: 12/897,093

(22) Filed: Oct. 4, 2010

(65) Prior Publication Data

US 2011/0242446 A1 Oct. 6, 2011

(30) Foreign Application Priority Data

Jan. 8, 2010 (KR) ..... 10-2010-0001945

(51) Int. Cl.
*G02F 1/1333* (2006.01)

(52) U.S. Cl.
USPC ..... 349/58; 349/59

(58) Field of Classification Search
USPC ..... 349/58, 59
See application file for complete search history.

(56) References Cited

U.S. PATENT DOCUMENTS

| | | | | |
|---|---|---|---|---|
| 5,281,325 | A * | 1/1994 | Berg | 205/125 |
| 5,662,967 | A * | 9/1997 | Ouyang | 427/409 |
| 5,817,196 | A * | 10/1998 | Teracher et al. | 148/547 |
| 8,253,880 | B2 * | 8/2012 | Park et al. | 349/58 |
| 2003/0218702 | A1 * | 11/2003 | Kwon et al. | 349/65 |
| 2007/0234776 | A1 * | 10/2007 | Shiga et al. | 72/325 |
| 2008/0007903 | A1 * | 1/2008 | Kim et al. | 361/681 |
| 2008/0055512 | A1 * | 3/2008 | Kim | 349/58 |

FOREIGN PATENT DOCUMENTS

| | | |
|---|---|---|
| JP | 2000-192191 | 7/2000 |
| JP | 2007-146234 | 6/2007 |
| JP | 2008-174802 | 7/2008 |

* cited by examiner

*Primary Examiner* — Edward Glick
*Assistant Examiner* — David Chung
(74) *Attorney, Agent, or Firm* — H. C. Park & Associates, PLC

(57) ABSTRACT

A method of fabricating a bottom chassis is provided. The method of fabricating the bottom chassis includes, for example, forming a bottom chassis using a steel plate having a thickness in the range of 0.5 mm to 0.9 mm, the steel plate having a stack structure including an inner layer containing 0.001 to 0.1 weight percent (wt. %) carbon (C), 0.002 to 0.05 wt. % silicon (Si), 0.28 to 2.0 wt. % manganese (Mn), balance iron (Fe), and other impurities, an electro-galvanized layer formed on the inner layer, and a polymer chromium (Cr)-free contamination resistant layer formed on the electro-galvanized layer, and performing a burring process and a tapping process on the bottom chassis to form a burring part to receive a bolt for an engagement.

22 Claims, 5 Drawing Sheets

METHOD OF FABRICATING BOTTOM CHASSIS, BOTTOM CHASSIS FABRICATED BY THE METHOD OF FABRICATING THE SAME, METHOD OF FABRICATING LIQUID CRYSTAL DISPLAY, AND LIQUID CRYSTAL DISPLAY FABRICATED BY THE METHOD OF FABRICATING THE SAME

CROSS-REFERENCE TO RELATED APPLICATION

This application claims priority to and the benefit of Korean Patent Application No. 10-2010-0001945 filed on Jan. 8, 2010, which is hereby incorporated by reference for all purposes as if fully set forth herein.

BACKGROUND OF THE INVENTION

1. Field of the Invention

Exemplary embodiments of the present invention relates to a bottom chassis, and is a method of fabricating a bottom chassis of a liquid crystal display (LCD).

2. Description of the Background

Liquid crystal displays (LCDs) have been adopted as one of the most widely used flat panel displays applicable to various electronics devices due to their low power consumption, low weight, thin structure, and high resolution.

An LCD typically includes a liquid crystal panel having two substrates and a liquid crystal layer interposed between the two substrates and displaying an image, a backlight unit irradiating light onto the liquid crystal panel, and a bottom chassis that can be disposed below the liquid crystal panel and the backlight unit to receive the liquid crystal panel and the backlight unit. The bottom chassis also dissipates heat from a light source, acts as a ground, and intercepts electromagnetic waves.

However, a conventional steel plate used to manufacture a bottom chassis may not have sufficient strength if the bottom chassis is too thin. To increase the strength of a bottom chassis, a steel plate that is thicker than 1 mm has mostly been used, which makes the bottom chassis bulky and thick as compared to other components of the LCD. Thus, there is a limited ability to reduce the overall thickness and weight of an LCD having a conventional thick bottom chassis. The above conventional bottom chassis may have a number of drawbacks. For example, it may be vulnerable to contamination from operator's fingerprints or affected by contaminants during an assembling process of manufacturing an LCD.

Thus, there is a need for an approach to make a thin, a high strength bottom chassis that can be suitable to achieve a slim, lightweight LCD and while also being a contaminant proof chassis.

SUMMARY OF THE INVENTION

Exemplary embodiments of the present invention provide a method of fabricating a bottom chassis formed using a new steel plate having a high contamination resistance while having a strength even with a small thickness, and providing a high-yield assembly by determining optimum factors affecting a tapping torque during a process and forming a burring part into which a screw can be inserted for engaging an object to the steel plate.

Additional features of the invention will be set forth in the description which follows, and in part will be apparent from the description, or may be learned by practice of the invention.

Exemplary embodiments of the present invention disclose a method for fabricating a bottom chassis. The method includes forming a chassis using a steel plate having a thickness in the range of about 0.5 mm to 0.9 mm. The steel plate has a stack structure comprising an inner layer, an electro-galvanized layer formed on the inner layer, and a polymer chromium (Cr)-free contamination resistant layer formed on the electro-galvanized layer. The inner layer comprises approximately 0.001 to 0.1 weight percent (wt. %) carbon (C), approximately 0.002 to 0.05 wt. % silicon (Si), approximately 0.28 to 2.0 wt. % manganese (Mn), iron (Fe), and other impurities. The method also includes providing a burring part by performing a burring process and a tapping process on the chassis for inserting a bolt for an engagement.

Exemplary embodiments of the present invention disclose a chassis. The chassis includes a steel plate having a thickness in the range of approximately 0.5 mm to 0.9 mm. The steel plate has a stack structure comprising an inner layer containing approximately 0.001 to 0.1 is weight percent (wt. %) carbon (C), approximately 0.002 to 0.05 wt. % silicon (Si), approximately 0.28 to 2.0 wt. % manganese (Mn), balance iron (Fe), and other impurities. An electro-galvanized layer is formed on the inner layer, and a polymer chromium (Cr)-free contamination resistant layer is formed on the electro-galvanized layer. The chassis comprises a burring part formed to receive a bolt for an engagement.

Exemplary embodiments of the present invention disclose a method of fabricating a liquid crystal display (LCD). The method includes providing a bottom chassis having a thickness in the range of about 0.5 mm to 0.9 mm. The bottom chassis has a stack structure comprising an inner layer containing about 0.001 to 0.1 weight percent (wt. %) carbon (C), about 0.002 to 0.05 wt. % silicon (Si), about 0.28 to 2.0 wt. % manganese (Mn), balance iron (Fe), and other impurities. An electro-galvanized layer is disposed on the inner layer, and a polymer chromium (Cr)-free contamination resistant layer is disposed on the electro-galvanized layer. A burring part is provided to receive a bolt to engage an object with the burring part via a hole formed in the object.

Exemplary embodiments of the present invention disclose a liquid crystal display. The liquid crystal display includes a bottom chassis having a thickness in the range of about 0.5 mm to 0.9 mm. The bottom chassis has a stack structure comprising an inner layer containing about 0.001 to 0.1 weight percent (wt. %) carbon (C), about 0.002 to 0.05 wt. % silicon (Si), about 0.28 to 2.0 wt. % manganese (Mn), balance iron (Fe), and other impurities. An electro-galvanized layer is disposed on the inner layer, and a polymer chromium (Cr)-free contamination resistant layer disposed on the electro-galvanized layer. The bottom chassis comprises a burring part formed to engage an object with the burring part via a hole formed in the object.

It is to be understood that both the foregoing general description and the following is detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
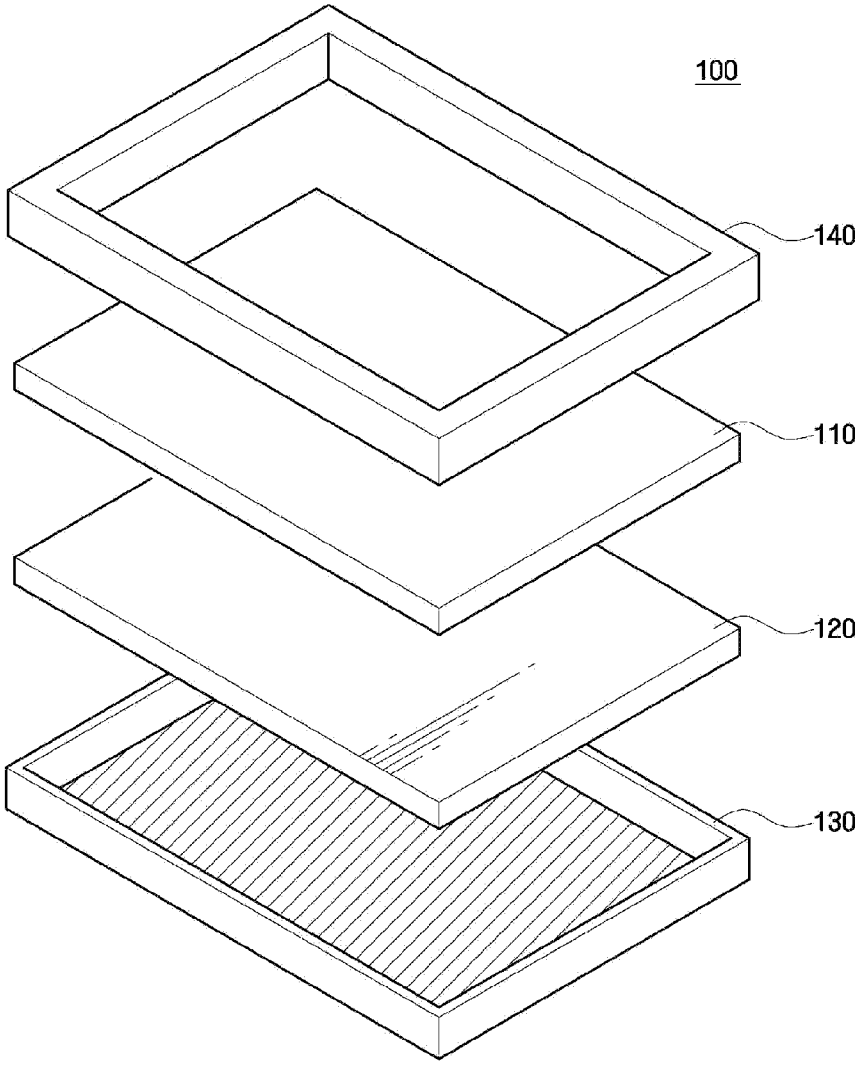
FIG. 1 is a perspective view of a liquid crystal display (LCD) according to exemplary embodiments of the present invention.

Advantages and features of the present invention can be understood more readily by reference to the following detailed description of exemplary embodiments and the accompanying drawings. The present invention may, however, be embodied in many different forms and should not be construed as being limited to the embodiments set forth herein. Rather, is these embodiments are provided so that this disclosure will be thorough and complete and will fully convey the concept of the invention to those skilled in the art, and the present invention will only be defined by the appended claims. Accordingly, in some specific embodiments, well known processing steps, devices or methods or redundant parts can be omitted in order to avoid unnecessarily obscuring the invention.

It is understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It is understood that, although the terms of a numerical term such as a first, second, third, they may be used herein to describe various elements, components, regions, layers and/or sections, these elements, components, regions, layers and/or sections should not be limited by these numerical terms. These terms are merely used to distinguish one element, component, region, layer or section from another element, component, region, layer or section. Thus, an element, a component, a region, a layer or a section designated as a "first" discussed below could be interpreted as an element, a component, a region, a layer or a section designated as a "second" without departing from the teachings of the present invention.

The terminology used herein is for the purpose of describing particular embodiments and is not intended to be limiting of the invention. As used herein, the singular forms "a," "an" and "the" are intended to include the plural forms as well, unless the context is clearly indicates otherwise. It is also understood that the terms "comprises" and/or "comprising," when used in this specification, can specify the presence of stated features, integers, steps, operations, elements, and/or components, but do not preclude the presence or addition of one or more other features, integers, steps, operations, elements, components, and/or groups thereof.

It is also noted that terms related to spatially relative terms, such as "below," "beneath," "lower," "above," "upper"—these terms may be used herein for ease of description to describe one element or feature's relationship to another element(s) or feature(s) as illustrated in the figures. It is understood that the spatially relative terms are intended to show different orientations of the device in use or operation in addition to the orientation depicted in the figures. For example, if the device in the figures is turned over, elements described as "below" or "beneath" other elements or features would then be oriented "above" or "on" with respect to the other elements or features. Thus, the term "under" can be interpreted to encompass both an orientation of above and below. The device may be otherwise oriented and the spatially relative descriptors used herein can be interpreted accordingly.

Hereinafter, the present invention will be described in further detail with reference to the accompanying drawings.

Figure 2:
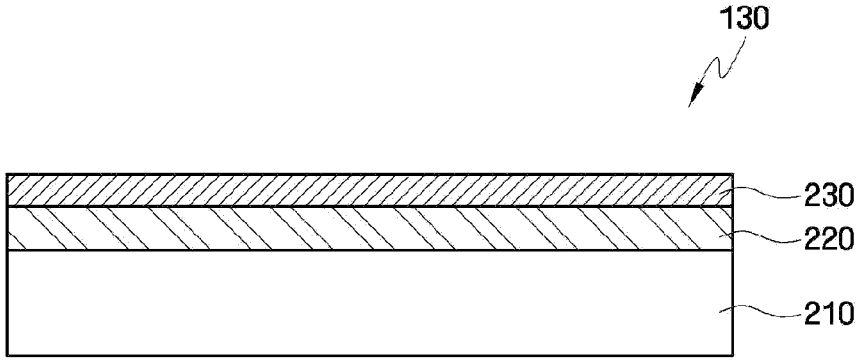
FIG. 2 is a cross-sectional view of a steel plate used as a bottom chassis shown in FIG. 1 in a vertical direction.

FIG. 1 is a perspective view of a liquid crystal display (LCD) 100 according to exemplary embodiments of the present invention. FIG. 2 is a cross-sectional view of a steel plate used as a bottom chassis shown in FIG. 1 in a vertical direction. The bottom chassis in FIG. 1 can be fabricated by a molding process of a steel plate which has a cross-section view as seen in FIG. 2.

Referring to FIG. 1, the LCD 100 may include a liquid crystal panel 110, a backlight unit 120, a bottom chassis 130, and a top chassis 140.

The liquid crystal panel 110 can display an image and may have a liquid crystal layer (not shown) interposed between a pair of substrates (not shown). One of the pair of substrates has thin-film-transistors (TFTs) to control liquid crystals and pixels that can be the smallest units of a screen. The other substrate may have a color filter with three, i.e., red (R), green (G), and blue (B) pixels coated onto a glass plate and realizing an image.

The backlight unit 120 can be disposed behind the liquid crystal panel 110 and can provide light to the liquid crystal panel 110. Although not shown in FIG. 1 and FIG. 2, the backlight unit 120 may include a light source, a reflection sheet, an optical plate such as a light guide plate or a diffusion sheet, and other optical sheets.

In some examples, the bottom chassis 130 can be disposed below the liquid crystal panel 110 and the backlight unit 120 and may receive the liquid crystal panel 110 and the backlight unit 120. To provide a space for receiving the liquid crystal panel 110 and the backlight unit 120, the bottom chassis 130 may comprise a bottom surface and side walls.

The top chassis 140 can be combined with the bottom chassis 130 and may define an effective display area of the liquid crystal panel 110.

As described above, the bottom chassis 130 can be fabricated using the steel plate of FIG. 2. The steel plate has a resistance against contaminations and a high strength even though it is thin. The steel plate is described in detail below with reference to FIG. 2.

Referring to FIG. 2, the steel plate can be used for making the bottom chassis 130 having a stack structure in which an inner layer 210, an electro-galvanized layer 220, and a polymer chromium (Cr)-free contamination resistant layer 230 (to be referred to as a "contamination resistant layer") can be stacked.

Upon the fabrication of the bottom chassis 130 using the steel plate, the inner is layer 210 on one side of the steel plate can be disposed in a direction to which the backlight unit 120 is received while the contamination resistant layer 230 on the other side can be disposed to an opposite direction to which the backlight unit 120 is received. Thus, the bottom chassis 130 may have the inner layer 210 at an inside surface, the contamination resistant layer 230 at an outside surface, and the electro-galvanized layer 220 interposed between the inner layer 210 and the contamination resistant layer 230.

It is contemplated that the inner layer 210 may contain about 0.001 to 0.1 weight percent (wt. %) carbon (C), about 0.002 to 0.05 wt. % silicon (Si), about 0.28 to 2.0 wt. % manganese (Mn), balance iron (Fe), and other impurities.

For example, C can be added to provide a sufficient strength of the inner layer 210. The C content may be in the range of about 0.001 to 0.1 wt. %. If the C content is less than about 0.001 wt. %, the inner layer 210 may not have a sufficient strength. If the C content is greater than about 0.1 wt. %, the inner layer 210 has a limited weldability and a low toughness.

Si can be added to obtain a sufficient strength due to solid-solution strengthening. The Si content may be in the range of about 0.002 to 0.05 wt. %. If the Si content is less than about 0.002 wt. %, a solid-solution strengthening effect of the inner layer 210 can be reduced. If the Si content is greater than about 0.05 wt. %, an interface oxide layer can be formed to degrade a surface quality.

The Mn can be added to obtain a sufficient strength and a high processibility of the inner layer 210. The Mn content may be in the range of about 0.28 to 2.0 wt. %. If the Mn content is less than about 0.28 wt. %, it may be difficult to obtain a sufficient strength and high processibility. If the Mn content is greater than about 2.0 wt. %, heterogeneity may occur due to Mn segregation.

Other impurities in the inner layer 210, for example, may include less than about 0.1 wt. % phosphorous (P), less than about 0.008 wt. % sulfur(S), about 0.01 to 0.03 wt. % chromium (Cr), about 0.007 to 0.015 wt. % nickel (Ni), about 0.001 to 0.004 wt. % molybdenum (Mo), about 0.043 to 0.045 wt. % aluminum (Al), about 0.02 to 0.04 wt. % copper (Cu), about 0.0017 to 0.0018 wt. % tin (Sn), less than about 0.004 wt. % oxygen (O), and less than about 0.003 wt. % nitrogen (N). If necessary, the impurities may further contain about 0.0075 to 0.0083 wt. % niobium (Nb) and about 0.0306 to 0.0310 wt. % titanium (Ti).

Referring to FIG. 2, the electro-galvanized layer 220 can be formed on the inner layer 210 by plating coatings of about 10 to 30 g/m$^2$ thereon. For example, electro-galvanization may be performed by plating coatings of about 20 g/m$^2$ using a sulfate bath.

The contamination resistant layer 230 can be formed on the electro-galvanized layer 220 by coating a polymer Cr-free composition. In some examples, the contamination resistant layer 230 can be based on polymer resin and may not contain Cr.

The contamination resistant layer 230 may contain about 10 to 30 wt. % amine based resin, about 10 to 50 wt. % silica compound, about 1 to 10 wt. % inorganic sol, and epoxy resin as remaining binder resin.

The amine based resin can provide sufficient adhesive strength to the contamination resistant layer 230 due to cross-linking. The content of the amine-based resin in the contamination resistant layer 230 may be about 10 to 30 wt. %. If the content of the amine based resin is less than about 10 wt. %, it cannot provide a sufficient adhesion strength due to cross-linking. If the content of the amine based resin is greater than about 30 wt. %, the processibility may be degraded.

The silica compound can be added to improve storage stability, adhesion, corrosion resistance, and processibility. The content of silica compound in the contamination resistant layer 230 may be about 10 to 50 wt. %. If the content of silica compound is less than about 10 wt. %, it may result in reduced conductivity. If the content exceeds about 50 wt. %, the processibility may be degraded.

The silica compound can be made with a mixture containing silica and silane at a ratio. For example, the silica compound may contain silica and silane mixed in a weight ratio of about 1:0.2 to 1:0.8. The silica can be selected from a humed silica or a colloidal silica, and the silane can be selected from glycidoxypropylethoxysilane, aminopropylethoxysilane, or methoxypropyltrimethoxysilane. If the silica and the silane are mixed in a weight ratio less than about 1:0.2, the contamination resistant layer 230 may exhibit a low degree of cross-linking. If the silica and the silane are mixed in a weight ratio greater than about 1:0.8, the contamination resistant layer 230 may have low processibility.

The contamination resistant layer 230 may also contain the inorganic sol in order to improve adhesion and corrosion resistance. The inorganic sol may be zircornia sol, alumina sol, titan sol, or a mixture of at least two of these materials. The content of inorganic sol in the contamination resistant layer 230 may be about 1 to 10 wt. %. If the content of inorganic sol is less than about 1 wt. %, the addition of the inorganic sol may have little effect on improving adhesion and corrosion resistance. If the content exceeds about 10 wt. %, corrosion resistance may increase while decreasing conductivity and processibility, thus, film formation may be difficult.

The epoxy resin can act as a binder resin and may form a dense barrier film. In addition, the epoxy resin can resist corrosive factors such as salt or oxygen and may have an excellent corrosion resistance as well as a chemical resistance.

The contamination resistant layer 230 may be formed by applying coatings of about 0.8 to 1.3 g/m$^2$. If a coating weight is less than about 0.8 g/m$^2$, it may be difficult to form into a bottom chassis having a desired shape. If the coating weight is greater than about 1.3 g/m$^2$, an electrical conductivity can be degraded such that the bottom chassis 130 may not be served as a ground for a circuit in a device or a light source in the backlight unit 120. The contamination resistant layer 230 may have a coating thickness of about 1 μm.

It is contemplated that a formation process of coatings on the contamination resistant layer 230 may include applying a solution which contains a solvent and materials discussed above on the electro-galvanized layer 220 to have a composition by utilizing the following process: one-coating-one-baking method, performing a baking-drying process, and performing water cooling or air cooling process.

The baking-drying process may be performed at a temperature in the range of about 140° C. to 220° C. If the baking-drying process is performed below about 140° C., the resin may not properly be cured, thereby degrading corrosion resistance and other physical properties of the coating layer. On the other hand, if the baking-drying process is performed above about 220° C., over-baking occurs. Consequently, the coating layer may crack or turn yellow in color.

The bottom chassis 130 may have a thickness of about 0.5 mm to 0.9 mm. If the bottom chassis 130 has a thickness greater than about 0.9 mm, it may not have a light weight, and thus may not achieve a slim design. If the bottom chassis 130 has a thickness less than about 0.5 mm, the electro-galvanized layer 220 and the contamination resistant layer 230 may become too thin, thereby degrading corrosion resistance or contamination resistance. Otherwise, the electro-galvanized layer 220 or the contamination resistant layer 230 may become thicker and the is inner layer 210 may become thinner, thereby reducing a mechanical strength of the bottom chassis 130.

The steel plate can be a high tensile steel plate with a tensile strength (TS) of about 300 MPa to 500 MPa and elongation of about 30% to 45%.

The fabrication and characteristics of the steel plate described above are described with a detailed explanation with reference to Examples discussed below, however, aspects of the present invention may not be limited to the Examples.

In some examples, exemplary steel plates can be illustrated. Steel plates can be processed to become a bottom chassis after conducting a molding process. In this example, inner layers may have the same compositions as in Example 1, Example 2, and Comparative Example seen in TABLE 1 and TABLE 2. An Electro-galvanization may be conducted by applying coatings of about 20 g/m$^2$ in a sulfate bath to form electro-galvanized layers. Thereafter, polymer Cr-free contamination resistant layers can be formed by applying coatings of about 1.0 g/m$^2$ over the electro-galvanized layers using one-coating-one-baking method, subsequent to a baking-drying process at temperature of about 180° C. and cooling.

TABLE 1

| | | Examples | | |
|---|---|---|---|---|
| | | Example 1 | Example 2 | Comparative Example |
| Elements added | C | 0.0013 | 0.0548 | 0.0168 |
| | Si | 0.0029 | 0.0062 | 0.0058 |
| | Mn | 0.3600 | 0.2810 | 0.1430 |
| | P | 0.0678 | 0.0141 | 0.0178 |
| | S | 0.0073 | 0.0046 | 0.0044 |
| | Cr | 0.0297 | 0.0112 | 0.0101 |
| | Ni | 0.0144 | 0.0073 | 0.0096 |
| | Mo | 0.0032 | 0.0017 | 0.0022 |
| | Al | 0.0432 | 0.0450 | 0.0375 |
| | Cu | 0.0351 | 0.0242 | 0.0111 |
| | Nb | 0.0079 | — | — |
| | Ti | 0.0308 | — | — |
| | Sn | 0.0017 | 0.0018 | 0.0014 |
| | O | 0.0032 | 0.0038 | 0.0040 |
| | N | 0.0015 | 0.0028 | 0.0019 |

TABLE 2 shows mechanical properties of the steel plates fabricated according to Example 1, Example 2, and Comparative Example.

TABLE 2

| Mechanical | Thickness | YP | TS | El | | r | |
|---|---|---|---|---|---|---|---|
| Properties | (mm) | (MPa) | (MPa) | (%) | n | r-bar | Δr |
| Example 1 | 0.810 | 215.5 | 374.3 | 40.75 | 0.241 | 1.76 | 0.01 |
| Example 2 | 0.802 | 221.4 | 355.4 | 42.51 | 0.235 | 1.67 | −0.51 |
| Comparative Example | 1.002 | 208.1 | 327.7 | 43.26 | 0.199 | 1.61 | 0.80 |

As evident from TABLE 2, the steel plates fabricated according to the Example 1 and the Example 2 may have a thickness of about 0.8 mm, which is about 80 percent of the thickness (1.0 mm) of the conventional steel plate fabricated according to the Comparative Example and may show slightly higher yield points (YP) and tensile strengths (TS) than those of the conventional steel plate.

Thus, the bottom chassis according to exemplary embodiments of the present invention, which can be formed using a steel plate, having the above-described physical properties, may be thinner than a conventional bottom chassis, yet maintain similar mechanical properties to the values of the conventional one, thereby achieving a lightweight, slim design. Accordingly, the overall thickness and weight of an LCD can be reduced. Further, the bottom is chassis may have a polymer Cr-free contamination resistant layer at an outside surface thereof, thereby preventing contamination during assembly.

In some examples, a bottom chassis may have a burring part for inserting a bolt formed on a bottom surface so as to engage various objects such as an inverter substrate or a shield case. The burring part may be formed by performing a burring process and a tapping process.

Since a bottom chassis fabricated using the above steel plate may be thinner than a conventional bottom chassis, it may be difficult to achieve a desired tapping torque during the tapping process. To achieve the desired tapping torque, it may be necessary to determine several factors to achieve optimum values that can affect a tapping torque during the burring process.

Thus, a method of fabricating a bottom chassis according to exemplary embodiments of the present invention may include factors possibly affecting an optimum value of a tapping torque during a process of forming a burring part on a bottom surface of the thin bottom chassis, thereby achieving a desired tapping torque during a subsequent tapping process. In this way, high assembling quality can be ensured.

A bottom chassis including a burring part and a method of fabricating the bottom chassis is described in detail with reference to FIG. 3 and FIG. 4. Hereinafter, a 'steel plate' can is refer to a steel plate having the same physical properties as described with reference to FIG. 2. A 'bottom chassis' can refer to a bottom chassis fabricated using the steel plate.

Figure 3:
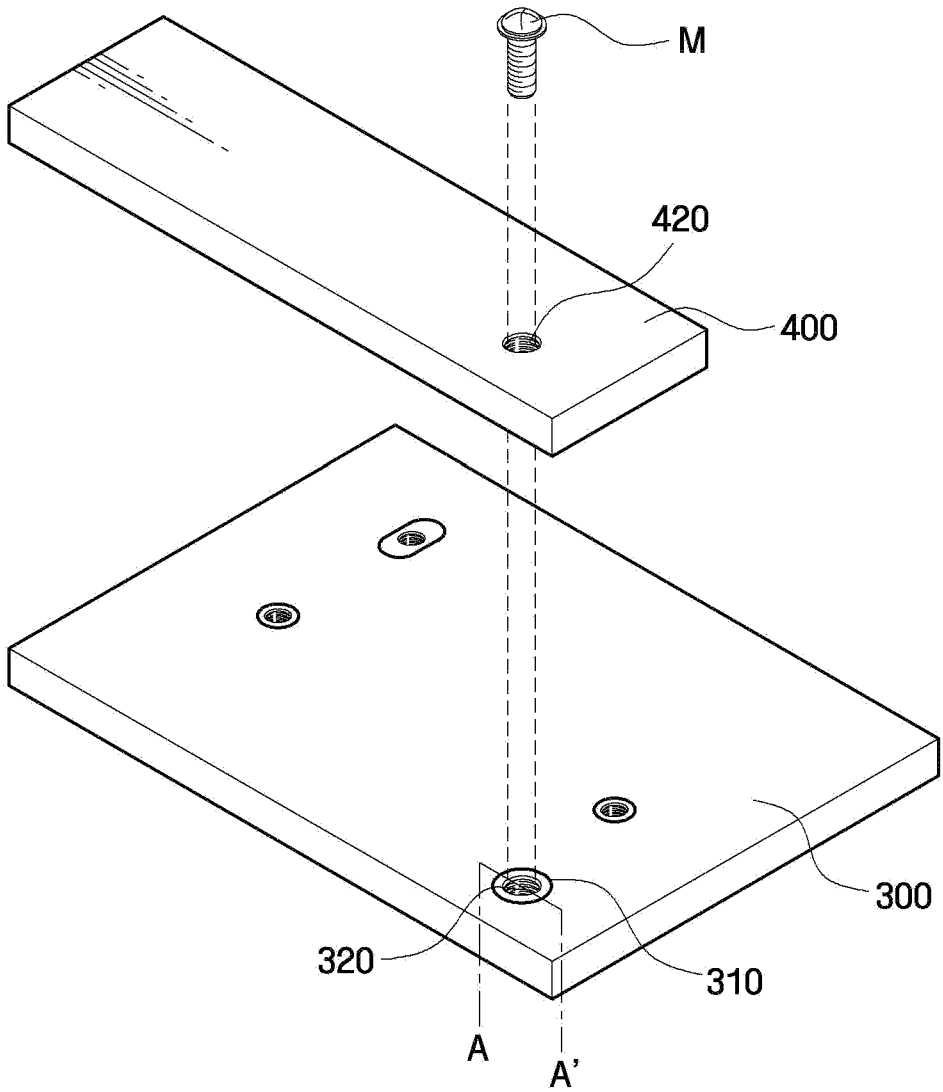
FIG. 3 is a perspective view of a bottom chassis fabricated according to exemplary embodiments of the present invention.
Figure 4:
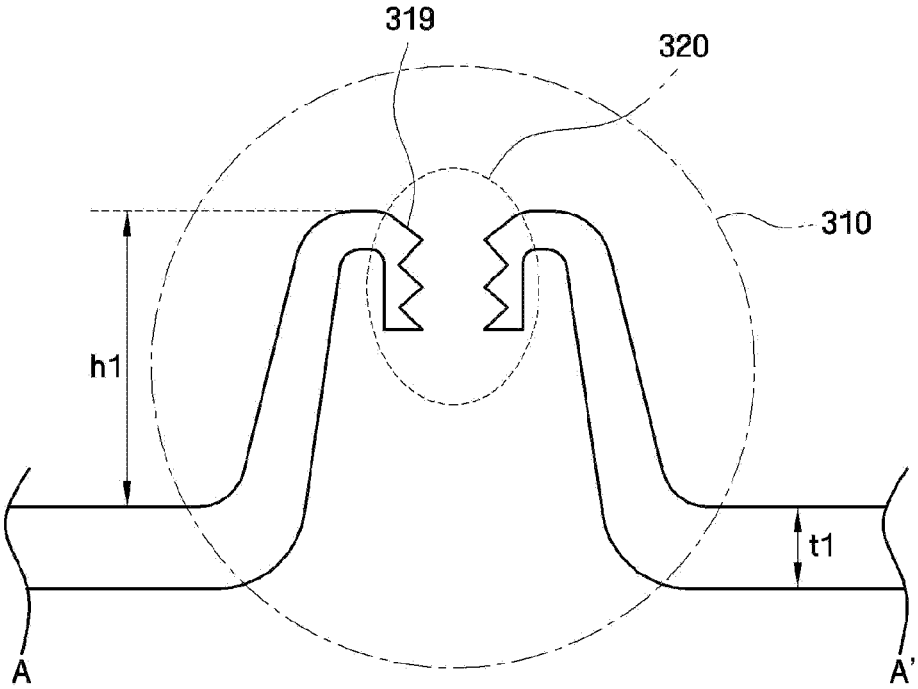
FIG. 4 is an enlarged cross-sectional view taken along line A-A' of FIG. 3.

FIG. 3 is a perspective view of a bottom chassis 300 fabricated according to exemplary embodiments of the present invention and FIG. 4 is an enlarged cross-sectional view taken along line A-A' of FIG. 3. FIG. 3 shows the bottom chassis 300 with from the perspective that its rear surface facing up.

Referring to FIG. 3 and FIG. 4, the bottom chassis 300 may have a bottom surface and sidewalls to provide a receiving space. The bottom chassis 300 may have at least one engaging portion 310 formed on the bottom surface so as to engage with a predetermined object 400 such as an inverter substrate or shield case disposed on the rear surface thereof.

In some examples, the engaging portion 310 can guide a position at which the object 400 can be fastened to the bottom surface 300. As illustrated in FIG. 4, the engaging portion 310 may have a protrusion projecting from the bottom surface toward the rear surface having a height h1, but the present invention is not limited thereto. For example, the engaging portion 310 may be a flat portion with a zero height h1. A number, a position, and a planar shape of the engaging portion 310 may not be limited to those illustrated in FIG. 3 and FIG. 4. The engaging portion 310 may have other various configurations for engaging the object 400.

The engaging portion 310 may have has a burring part 320 for inserting a bolt. The formation of the burring part 320 will be described below with reference to FIG. 6, FIG. 7, FIG. 8 and FIG. 9.

In some examples, the object 400 fixed to a rear surface of the bottom chassis 300 has a throughhole 420 corresponding to the burring part 320 on the bottom chassis 300.

The bolt M can pass through the throughhole 420 in the object 400 and can join with the burring part 320 so that the object 400 can be fastened to the bottom chassis 300.

Figure 5:
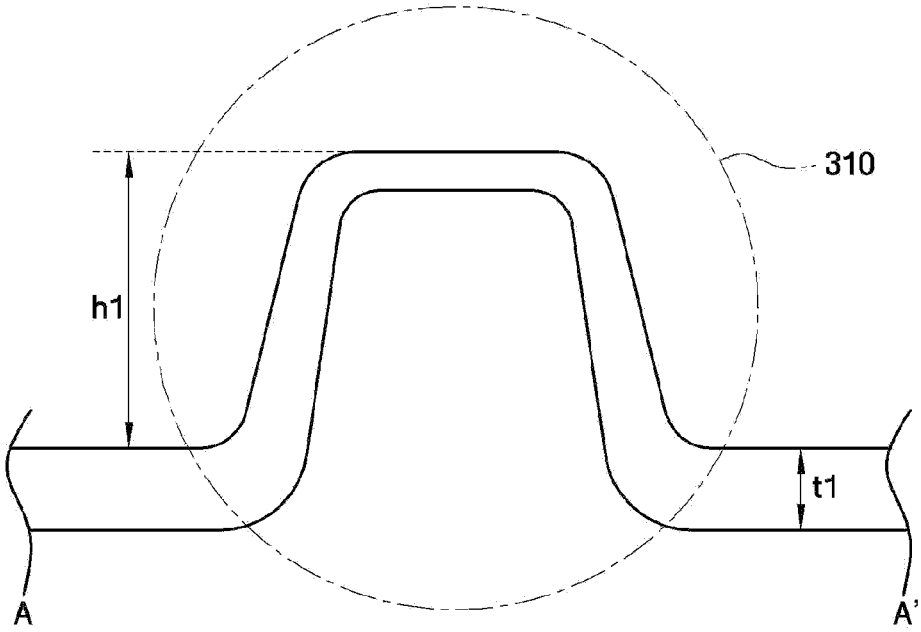
FIG. 5, FIG. 6, FIG. 7, FIG. 8 and FIG. 9 are cross-sectional views for illustrating a method of fabricating the bottom chassis shown in FIG. 3.
Figure 6:
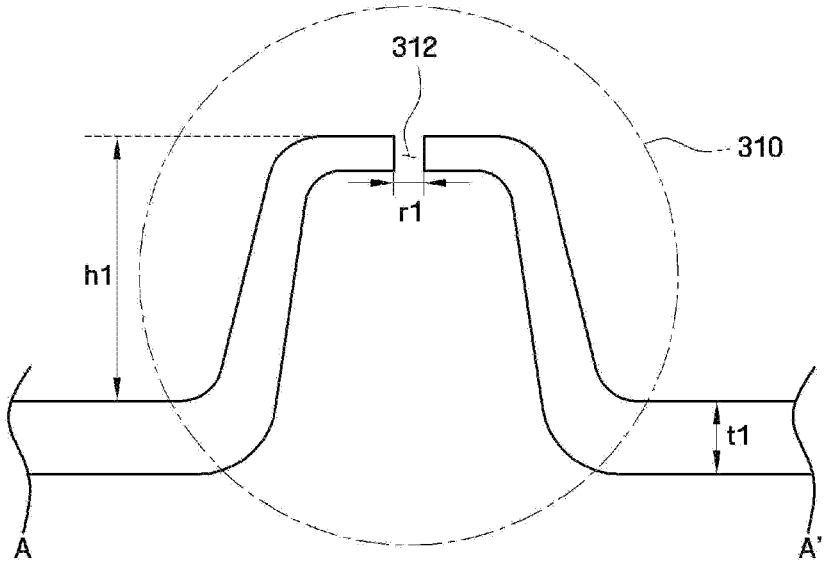

A method of fabricating a bottom chassis 300 according to exemplary embodiments of the present invention is described in detailed explanation with reference to FIG. 5, FIG. 6, FIG.

Figure 7:
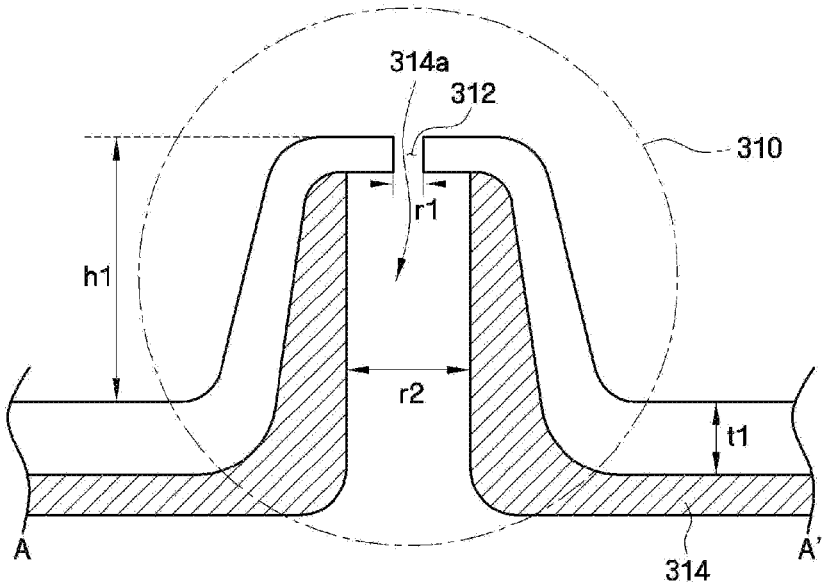
Figure 8:
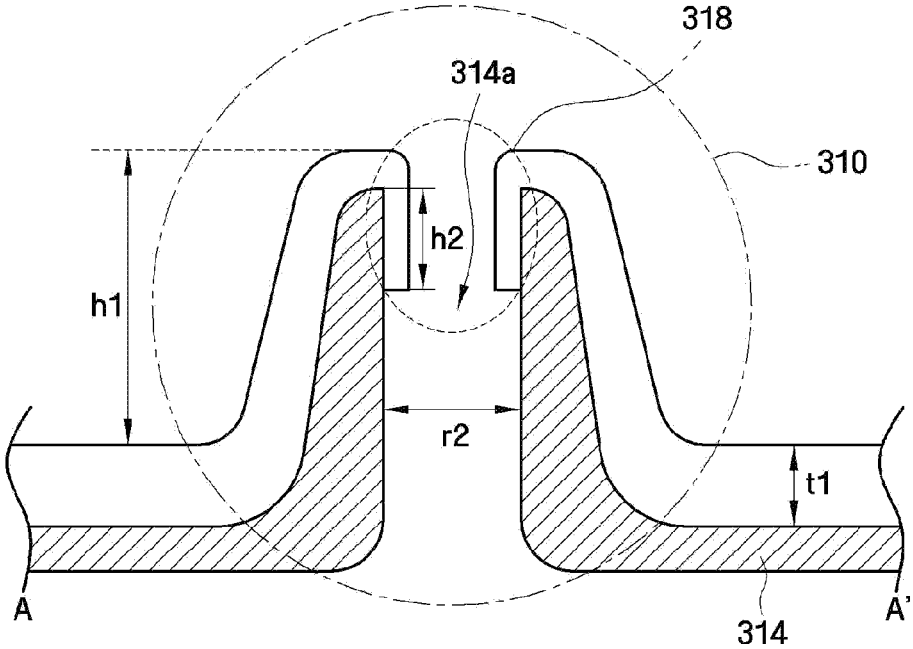
Figure 9:
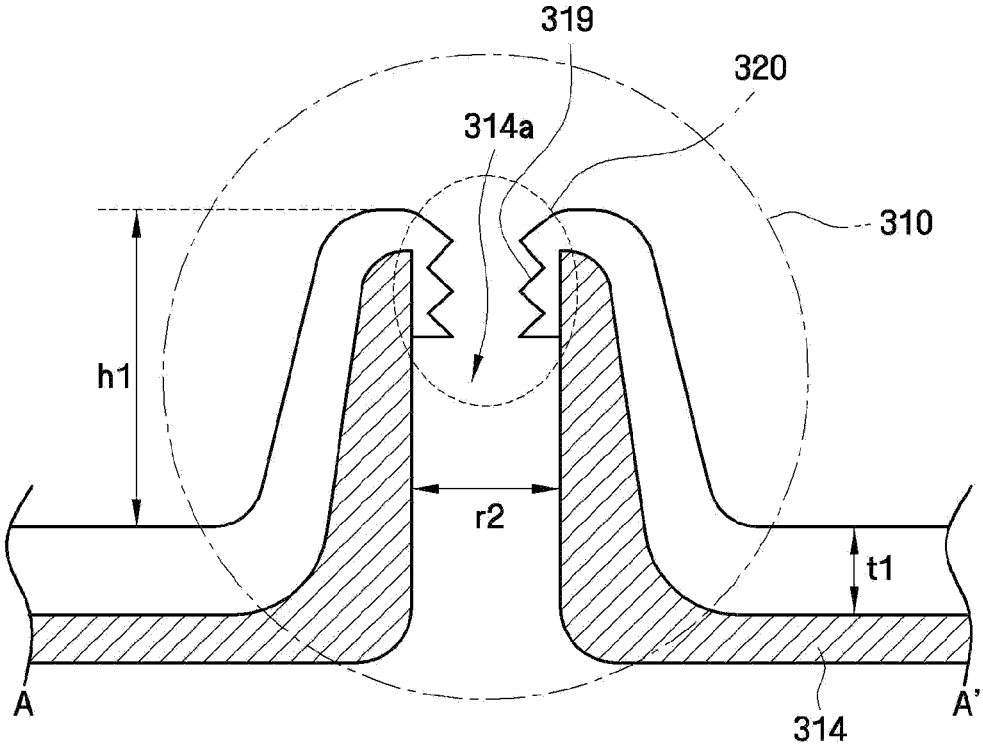

7, FIG. 8 and FIG. 9. FIG. 5, FIG. 6, FIG. 7, FIG. 8 and FIG. 9 are cross-sectional views for explaining the method of fabricating the bottom chassis 300 shown in FIG. 3. The cross-sectional views can be based on an enlarged cross-sectional view taken along line A-A' of FIG. 3.

Referring to FIG. 5, the bottom chassis 300 may have a bottom surface and side walls for providing a receiving space.

An engaging portion 310 can be formed on the bottom surface of the bottom chassis 300 so as to guide a position at which the object 400 is fastened to the bottom chassis 300. For example, a pressure can be applied to a region of the bottom surface in which the engaging portion 310 can be formed so that the engaging portion 310 can protrude towards the rear surface of the bottom chassis 300 with a height h1. The projecting engaging portion 310 may have a thickness that can be varied with a position. For example, the engaging portion 310 can be tapered toward a top surface thereof.

However, aspects of the present invention are not limited thereto, and for example, engaging portion 310 may have a flat shape. In this example, the engaging portion 310 may have the same uniform thickness as thickness t1 of the bottom surface of the bottom chassis 300, i.e., the thickness of the steel plate.

Referring to FIG. 6, FIG. 7, FIG. 8 and FIG. 9, a process of forming a burring part can subsequently be performed. FIG. 6, FIG. 7, FIG. 8 are cross-sectional views for explaining a burring process and FIG. 9 is a cross-sectional view for explaining a tapping is process.

For example, piercing can be performed to punch a hole in a part of the engaging portion 310 and can form a piercing hole 312. The piercing hole 312 may be an initial hole for forming a burring part. When the engaging portion 310 has a projecting shape as an example, the piercing hole 312 can be formed on a flat part, i.e., a top surface of the engaging portion 310.

Referring to FIG. 7, a burning die 314 can be disposed on a front surface of the bottom chassis 300 and has an opening 314*a* with a diameter greater than that of the piercing hole 312 and a burring punch which will be described below. In this example, the burring die 314 can come into to contact with the engaging portion 310 so that the opening 314*a* and the piercing hole 312 can overlap each other. The piercing hole 312 may overlap a central portion of the opening 314*a*.

Referring to FIG. 8, a burring tool, i.e., a burring punch (not shown) having a diameter greater than that of the piercing hole 312 can be pushed into the piercing hole 312 towards the front surface of the bottom chassis 300 to produce an initial burring part 318 having a shape as indicated by the dotted line. The initial burring part 318 can be referred to as a burring part formed before being subjected to a tapping process.

Referring to FIG. 9, a tapping process can be performed to form a screw tap 319 along an inner circumference of the initial burring part 318, thereby completing a burring part 320. The tapping process can be conducted using a tapping tool (not shown) that can be inserted into the initial burring part 318 for a rotation. For example, the tapping process can be performed using a rolling tap in order to prevent from loss of the cross-sectional area of the burring part 320.

Factors that can affect a tapping torque during the tapping process may include a is thickness of a steel plate, i.e., the thickness t1 of the bottom surface, sidewalls of the bottom chassis 300, diameter r1 of the piercing hole 312, diameter r2 of the opening 314*a* of the burring die 314, and a height h2 of the initial burring part 318. In this example, the initial burring part 318 may have substantially the same height h2 as the burring part 320.

In some examples, the thickness of the steel plate can be in the range of about 5 mm to 9 mm, preferably about 6 mm.

For example, with respect to a thickness t1 of the steel plate, and if the burring part 320 is provided for inserting an 3 mm diameter M3 bolt the piercing hole 312 may have about 1.0 mm to 1.4 mm diameter r1 and the opening 314*a* may have about 3.2 mm to 3.6 mm diameter r2. For example, if the height h1 of the engaging portion 310 is 0 which means the engaging portion 310 has a flat shape, the height h2 of the initial burring part 318 may be in the range of about 0.9 mm to 1.3 mm. If the height h1 of the engaging portion 310 exceeds 0, the height h2 of the initial burring part 318 may decrease compared to when the height h1 is 0.

In some examples, if the burring part 320 is provided for inserting a 4 mm diameter M4 bolt, the piercing hole 312 may have about 1.4 mm to 1.8 mm diameter r1 and the opening 314*a* may have about 4.2 mm to 4.6 mm diameter r2. Furthermore, if the height h1 of the engaging portion 310 is 0, the height h2 of the initial burring part 318 may be in the range of about 1.2 mm to 1.6 mm. If the height h1 of the engaging portion 310 exceeds 0, the height h2 of the initial burring part 318 may decrease compared to when the height h1 is 0.

By determining optimum values for the thickness t1, the diameters r1 and r2, and the height h2, a desired tapping torque can be obtained for the tapping process, which is shown in Examples seen in TABLE 3 below. However, aspects of the present invention are not limited to the Examples.

TABLE 3

| | Examples | | |
|---|---|---|---|
| Factors | Example 1 | Example 2 | Example 3 |
| Steel Plate Thickness (mm) | 0.6 | 0.6 | 0.6 |
| Piercing Hole Diameter (mm) | 1.2 | 1.6 | 1.6 |
| Opening Diameter (mm) | 3.4 | 4.4 | 4.4 |
| Burring Part Height (mm) | 1.1 | 1.4 | 0.83 |
| Tapping Torque (Kgf · cm) | 7 | 13 | 13 |
| Number of Tapping (times) | 20 | 20 | 20 |

Example 1 shows conditions for forming a burring part when an M3 bolt is to be inserted into the 0.6 mm thick steel plate. As evident from Example 1, if the diameter r1 of the piercing hole 312, the diameter r2 of the opening 314*a* on the burring die 314, and the height h2 of the initial burring part 318 (if the height h1 of the engaging portion 310 is 0) are 1.2 mm, 3.4 mm, and 1.1 mm, respectively, a tapping tool can repeatedly be engaged 20 times with a tapping torque 7 Kgf cm during the tapping process.

Example 2 shows conditions for forming a burring part when an M4 bolt is inserted into the 0.6 mm thick steel plate. As evident from Example 2, if the diameter r1, the diameter r2, and the height h2 (if the h1 is 0) are 1.6 mm, 4.4 mm, and 1.4 mm, respectively, a tapping tool can repeatedly be engaged 20 times with a tapping torque 13 Kgf cm during the tapping process.

Example 3 shows conditions for forming a burring part when an M4 bolt is inserted into the 0.6 mm thick steel plate and the height h1 of the engaging portion 310 is 8 mm. As evident from Example 3, if the diameter r1, the diameter r2, and the height h2 (if the h1 is 8 mm) are 1.6 mm, 4.4 mm, and 0.83 mm, respectively, a tapping tool can repeatedly be engaged 20 times with a tapping torque 13 Kgf cm during the tapping process.

As described above, exemplary embodiments of the present invention can provide the optimum values of a steel plate in terms of a thickness and other factors used for a burring process and thus can achieve a desired tapping torque for a tapping process, thereby ensuring a high assembling quality between the bottom chassis and another object. Accordingly, a high throughput of LCDs can be achieved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method, comprising:

forming a chassis using a steel plate having a thickness in the range of about 0.5 mm to 0.9 mm, the steel plate having a stack structure comprising an inner layer, an electro-galvanized layer formed on the inner layer, and a polymer chromium (Cr)-free contamination resistant layer formed on the electro-galvanized layer, wherein the inner layer comprises approximately 0.001 to 0.1 weight percent (wt. %) carbon (C), approximately 0.002 to 0.05 wt. % silicon (Si), approximately 0.28 to 2.0 wt. % manganese (Mn), iron (Fe), and other impurities; and providing a burring part by performing a burring process and a tapping process on the chassis for inserting a bolt for an engagement.

2. The method of claim 1, wherein the burring process comprises forming a piercing hole in the chassis, positioning a burring die having an opening with a diameter greater than a diameter of the piercing hole on one surface of the chassis, wherein the piercing hole and the opening overlap each other, and pushing a burring tool having a diameter greater than the diameter of the piercing hole into the piercing hole, the insertion being performed from the other surface toward the one surface of the chassis.

3. The method of claim 2, wherein the bolt is an M3 bolt, the diameter of the piercing hole is in the range from about 1.0 mm to about 1.4 mm, and the diameter of the opening on the burring die is in the range from about 3.2 mm to about 3.6 mm.

4. The method of claim 3, wherein the burring part has a height ranging from about 0.9 mm to about 1.3 mm.

5. The method of claim 3, wherein the chassis has a protrusion portion projecting from the one surface towards the other surface, and the burring part is formed in the protrusion portion, wherein the height of the burring part decreases as the height of the protrusion portion increases.

6. The method of claim 2, wherein the bolt is an M4 bolt, the diameter of the piercing hole is in the range from about 1.4 mm to about 1.8 mm, and the diameter of the opening on the burring die is in the range from about 4.2 mm to about 4.6 mm.

7. The method of claim 6, wherein the burring part has a height ranging from about 1.2 mm to about 1.6 mm.

8. The method of claim 6, wherein the chassis has a protrusion portion projecting from one surface to other surface, and the burring part is formed in the protrusion portion, wherein the height of the burring part decreases as the height of the protrusion portion increases.

9. The method of claim 2, wherein the steel plate has a thickness of about 0.6 mm, the bolt is an M3 bolt, the diameter of the piercing hole is about 1.2 mm, and the diameter of the opening on the burring die is about 3.4 mm.

10. The method of claim 9, wherein the burring part has a height of about 1.1 mm.

11. The method of claim 2, wherein the steel plate has a thickness of about 0.6 mm, the bolt is an M4 bolt, the diameter of the piercing hole is about 1.6 mm, and the diameter of the opening on the burring die is about 4.4 mm.

12. The method of claim 11, wherein the burring part has a height of about 1.4 mm.

13. A chassis, comprising:

a steel plate having a thickness in the range of approximately 0.5 mm to 0.9 mm, the steel plate having a stack structure comprising an inner layer containing approximately 0.001 to 0.1 weight percent (wt. %) carbon (C), approximately 0.002 to 0.05 wt. % silicon (Si), approximately 0.28 to 2.0 wt. % manganese (Mn), iron (Fe), and other impurities, wherein an electro-galvanized layer formed on the inner layer, and a polymer chromium (Cr)-free contamination resistant layer formed on the electro-galvanized layer, and wherein the chassis comprises a burring part formed to receive a bolt for an engagement.

14. The chassis of claim 13, wherein the bolt is an M3 bolt, and the burring part is formed by piercing hole formed in the chassis having a diameter in the range from about 1.0 mm to about 1.4 mm, and a burring die with an opening overlapping the piercing hole and having a diameter in the range from about 3.2 mm to about 3.6 mm.

15. The chassis of claim 14, wherein the burring part has a height ranging from about 0.9 mm to about 1.3 mm.

16. The chassis of claim 13, wherein the bottom chassis has a protrusion portion projecting from one surface to the other surface, and the burring part is formed in the protrusion portion.

17. The chassis of claim 13, wherein the bolt is an M4 bolt, and the burring part is formed by piercing hole formed in the chassis having a diameter in the range from about 1.4 mm to about 1.8 mm, and a burring die with an opening overlapping the piercing hole and having a diameter in the range from about 4.2 mm to about 4.6 mm.

18. The chassis of claim 17, wherein the burring part has a height ranging from about 1.2 mm to about 1.6 mm.

19. A liquid crystal display (LCD), comprising:

a bottom chassis having a thickness in the range of about 0.5 mm to 0.9 mm, the bottom chassis having a stack structure comprising an inner layer containing about 0.001 to 0.1 weight percent (wt. %) carbon (C), about 0.002 to 0.05 wt. % silicon (Si), about 0.28 to 2.0 wt. % manganese (Mn), balance iron (Fe), and other impurities, wherein an electro-galvanized layer disposed on the inner layer, and a polymer chromium (Cr)-free contamination resistant layer disposed on the electro-galvanized layer, wherein the bottom chassis comprises a burring part formed to engage an object with the burring part via a hole formed in the object.

20. The method of claim 1, wherein the tensile strength of the inner layer is about 300 MPa to about 500 MPa.

21. The chassis of claim 13, wherein the tensile strength of the inner layer is about 300 MPa to about 500 MPa.

22. The LCD of claim 19, wherein the tensile strength of the inner layer is about 300 MPa to about 500 MPa.

* * * * *